US006565323B2

(12) United States Patent
Kim

(10) Patent No.: US 6,565,323 B2
(45) Date of Patent: May 20, 2003

(54) PROPELLER FAN

(75) Inventor: Jae-Won Kim, Seoul (KR)

(73) Assignee: Sun Moon University, Asan (KR)

( * ) Notice: Subject to any disclaimer, the term of this patent is extended or adjusted under 35 U.S.C. 154(b) by 35 days.

(21) Appl. No.: 09/929,369

(22) Filed: Aug. 15, 2001

(65) Prior Publication Data

US 2002/0041806 A1 Apr. 11, 2002

(30) Foreign Application Priority Data

Aug. 30, 2000 (KR) ..... 2000-50716

(51) Int. Cl.[7] ..... F04D 29/38

(52) U.S. Cl. ..... 416/223 R; 416/DIG. 2; 416/243

(58) Field of Search ..... 416/243, DIG. 2, 416/DIG. 5, 237, 242, 223 R, 235, 228, 236 R

(56) References Cited

U.S. PATENT DOCUMENTS 2,524,870 A * 10/1950 Adamtchik
4,073,601 A * 2/1978 Kress ..... 416/242
4,802,822 A * 2/1989 Gilgenbach et al. ..... 416/235
4,865,520 A * 9/1989 Hetzel et al. ..... 416/236 R
4,941,803 A * 7/1990 Wainauski et al. ..... 416/242
5,017,090 A * 5/1991 Morrison ..... 416/168 R

* cited by examiner

*Primary Examiner*—Edward K. Look
*Assistant Examiner*—James M McAleenan
(74) *Attorney, Agent, or Firm*—Morgan, Lewis & Bockius LLP

(57) ABSTRACT

A propeller fan adapted to prevent abnormal air flow to thereby increase discharge of air flow but to decrease noise, the fan including a plurality of vanes, each vane fixed at a hub secured at a rotary axle, having a predetermined length toward external radial direction thereof and circumferentially spaced out at a predetermined gap, wherein each van has a cross-sectional shape like a flat surface at an external side of a leading edge thereof while an external side of a trailing edge thereof is bent with a predetermined radius of curvature (Rc).

2 Claims, 4 Drawing Sheets

PROPELLER FAN

BACKGROUND OF THE INVENTION

1. Field of the Invention

The present invention relates to a propeller fan, and more particularly to vanes of propeller fan.

2. Background of the Invention

Generally, as shown in FIG. 3, a propeller fan has a plurality of vanes 4, each circumferentially spaced out at a predetermined distance and fixed at a hub 2 secured at a rotating axis (motor axis), having a predetermined length. The hub 2 is externally protruded with arms 6 to which the vanes 4 are attached by rivets 8. Each vane 4 has a cross-sectional shape like a curved plate from the leading part 10 to the trailing part 12 as illustrated in FIG. 4.

When the vanes 4 of the fan are rotated as per activation of a motor, a pressure difference is generated between the front side and the rear side of the fan, and air at the back side of the fan is discharged forward by the pressure difference. The vanes also serve to guide the floor of air discharged forward.

However, there is a problem in the vanes each having the cross-sectional shape illustrated in FIG. 4 according to the prior art in that an abnormal flow phenomenon is greatly generated where reverse flow of air occurs at or near surface of the vanes and noises are also created.

FIG. 5 is a graph for illustrating velocity distribution at the van of the fan having the cross-sectional shape of FIG. 4, where R defines a radial distance from a hub to a tip end of the vane along external radial direction of the hub, Vz is an air velocity at the surface of the vane, the symbols of rectangle (□) at the curve of the graph is the leading edge of the vane, the triangle (Δ) is the trailing edge of the vane and the circle (o) represents a medium part between the leading edge and the trailing edge of the vane.

As illustrated in FIG. 5, the air is noticed to flow backward as the air nears the hub of the vane (Vz is negative number), where noise is measured at 89 dB(A).

When the air flows backward on the surface of the vane, flow loss is increased to decrease fan efficiency, thereby resulting in generation of abnormal noise.

SUMMARY OF THE INVENTION

The present invention is disclosed to solve the aforementioned problems and it is an object of the present invention to provide a propeller fan adapted to prevent generation of abnormal flow such as reverse flows and the like to thereby increase fan efficiency and to keep from generation of abnormal noise.

In accordance with the object of the present invention, there is provided a propeller fan, the fan including a plurality of vanes, each vane fixed at a hub secured at a rotary axle, having a predetermined length toward external radial direction thereof and circumferentially spaced out at a predetermined gap, wherein each van has a cross-sectional shape like a flat surface at an external side of a leading edge thereof while an external side of a trailing edge thereof is bent with a predetermined radius of curvature (Rc), where the radius of curvature (Rc) is preferred to satisfy the following formula;

$$Rc = \frac{(0.55 \sim 0.60)}{R_L}$$

where, $R_L$ is a vane length measured toward external radial direction of hub and $R_L$ is preferred to satisfy the following formula:

$$R_L = \frac{1}{2}\sqrt{\frac{2\nu R_e}{\omega}}$$

where, ν is coefficient of kinematic viscosity

Re is a critical Reynolds number and

ω is an angular velocity of fan, while an angle (θ) at bent region of the trailing edge is preferred to have 8°~18°.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PRESENT INVENTION

Now, preferred embodiments of the present invention are described in detail with reference to the accompanying drawings.

Figure 1:
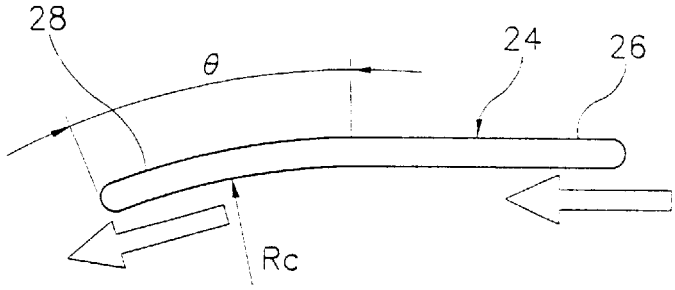
FIG. 1 is a sectional view for illustrating a vane of propeller fan according to an embodiment of the present invention.

FIG. 1 illustrates a cross-sectional view of a vane according to an embodiment of the present invention, where the cross-sectional view of the vane 24 at the propeller fan has a flat surface at an external side of a leading edge 26 while an external side of a trailing edge 28 is curved at a predetermined radius of curvature (Rc).

Figure 3:
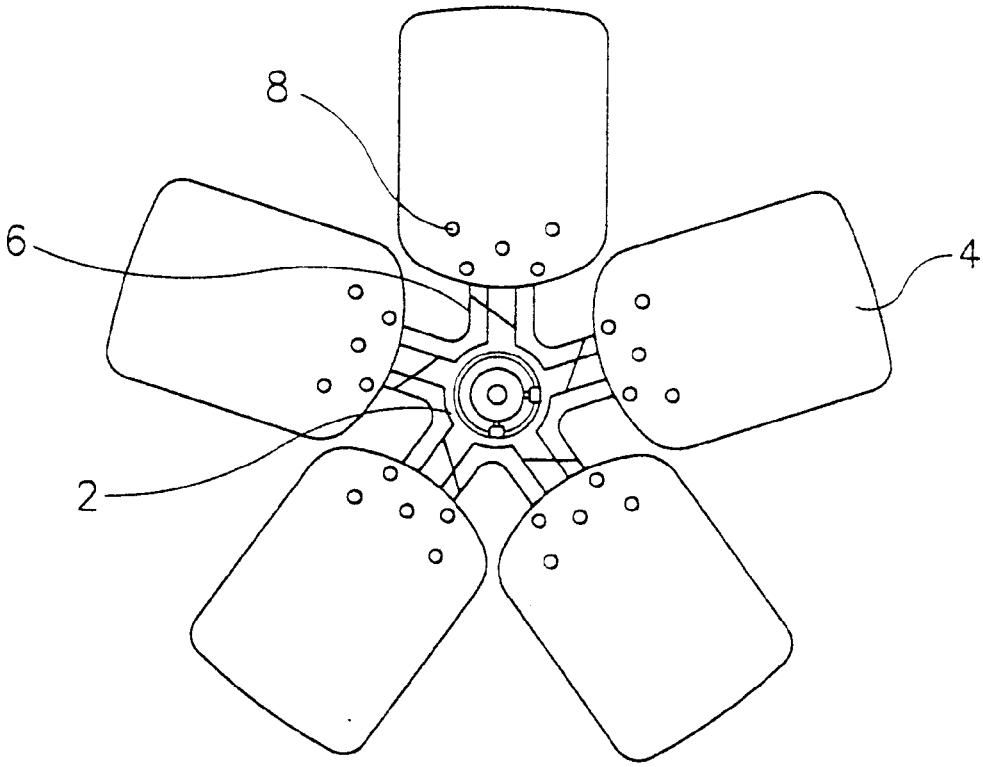
FIG. 3 (prior art)
FIG. 3 is a plan of a vane at a propeller fan according to the prior art.
Figure 4:
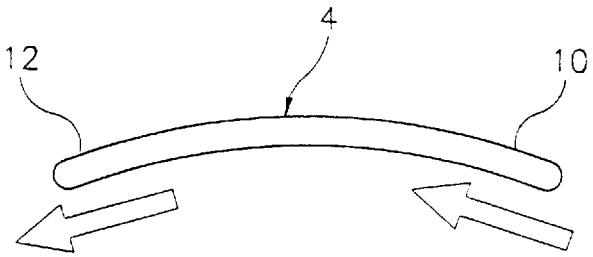
FIG. 4 (prior art)
FIG. 4 is a cross-sectional view of the vane in FIG. 3.
Figure 5:
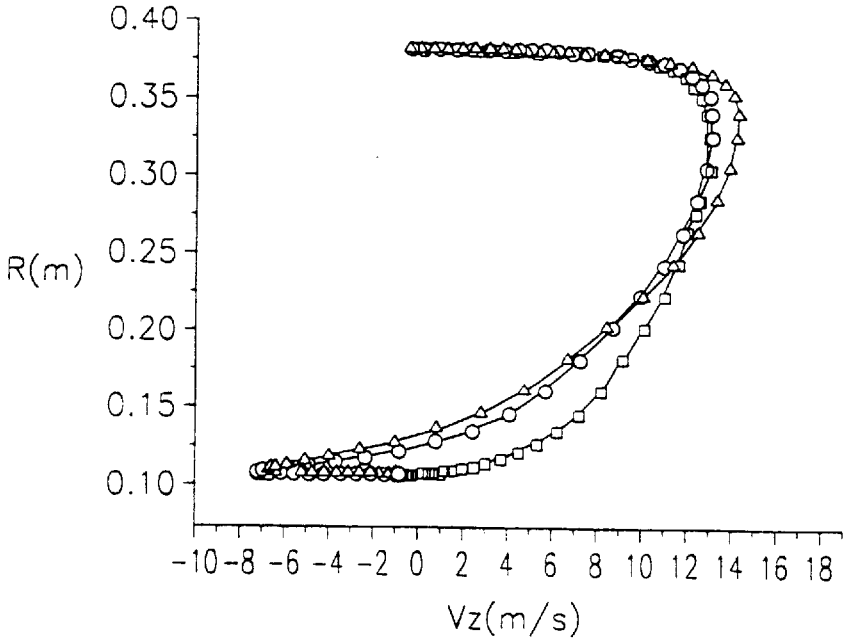
FIG. 5 is a velocity distribution graph at a van surface of propeller fan equipped with vanes each having a cross-sectional shape as in FIG. 4.

The vane 24 is a plate of constant thickness and a middle section between the leading edge 26 and the trailing edge 28 is thicker than the other sections. The vanes of the propeller fan according to the present invention thus described are applicable to the propeller fans in FIG. 3 and FIG. 6 as well.

Figure 6:
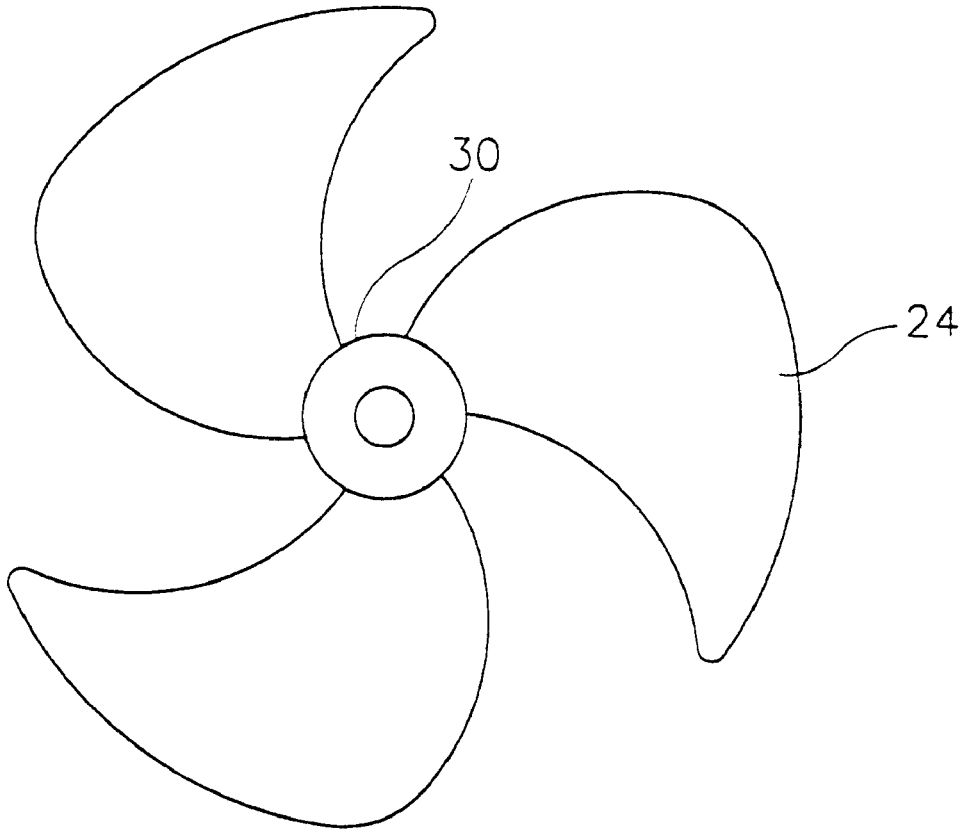
FIG. 6 is a plan of a vane at a propeller fan according to another embodiment of the present invention.

FIG. 6 illustrates the vanes each directly fixed to an external surface of the hub 30 secured to the rotary axle, where the vanes are fixed by rivets or the like, or by way of welding.

The radius of curvature (Rc) is preferred to satisfy the following formula.

$$R_C = \frac{0.55 \sim 0.6}{R_L} = \frac{0.55 \sim 0.6}{\frac{1}{2}\sqrt{\frac{2\nu Re}{\varpi}}} = \frac{0.55 \sim 0.6}{\frac{1}{2}\sqrt{\frac{2\nu}{\varpi}\frac{UR_L}{\nu}}} = \frac{1.1 \sim 1.2}{\sqrt{\frac{2UR_L}{\varpi}}}$$

where ω is angular velocity of fan

U is maximum rotating speed of blade $R_L$ is radial distance of blade, and $$R_L = \frac{1}{2}\sqrt{\frac{2\nu Re}{\omega}}$$

where, ν is coefficient of kinematic viscosity.

Re is critical Reynolds number and

ω is angular velocity of fan.

Furthermore, the radius of curvature (Rc) is preferred to satisfy the formula of $Rc=0.575/R_L$.

$R_L$ can be derived by the following formula, that is:

$$Re = \frac{UR_L}{\nu}$$

$$\text{where, } R_L = \frac{\nu Re}{U} = \frac{\nu Re}{R_L \omega}$$

and U is maximum rotating velocity at blade tip.

The angle (θ) at bent region of the trailing edge 28 is preferred to be 8°~18°.

Figure 2:
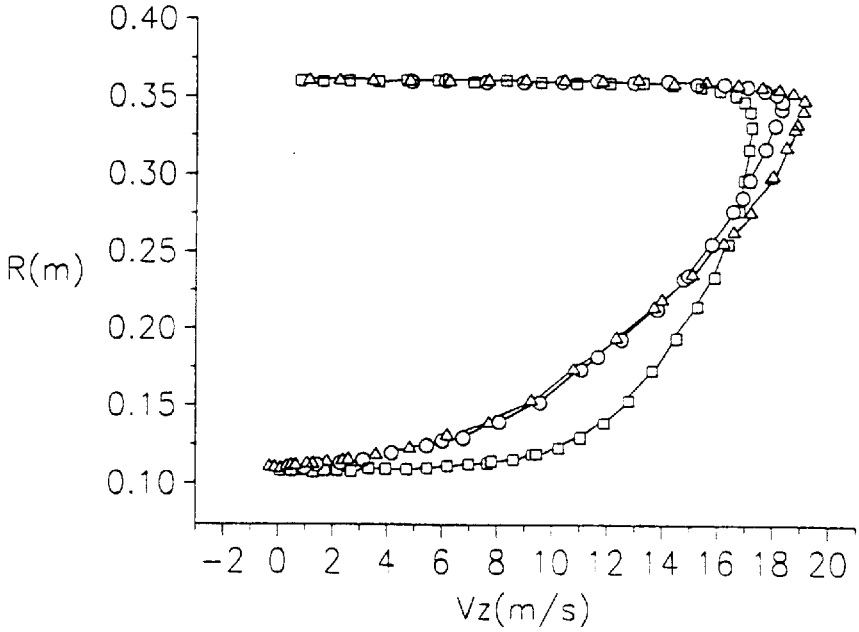
FIG. 2 is a velocity distribution graph at a vane surface of propeller fan equipped with vanes each having a cross-sectional shape as in FIG. 1.

FIG. 2 is a velocity distribution graph at a vane surface of propeller fan equipped vanes each having a cross-sectional shape as in FIG. 1, where R defines a distance from a hub lateral end of the vane to a tip end of the vane along external radial direction of the hub, Vz is an air velocity at the surface of the vane, the rectangle (□) at the curve of the graph is the leading edge of the vane, the triangle (Δ) is the trailing edge of the vane and the circle (o) represents a medium part between the leading edge and the trailing edge of the vane.

As illustrated in the graph of FIG. 2, no backward air flow is noticed at the hub side of the vanes, where, Vz is positive number. Noise measured by a general noise detector is given at 2.5 dB(A), which is remarkably reduced data, compared with the noise of 89 dB(A) according to the prior propeller fan.

Meanwhile, quantity of air flow is increased by 15~19% compared with that of propeller fan having shapes of vanes according to the prior art. The quantity of air flow was tested under static pressure of 8 mmAq. by the general method to be compared with the propeller fan of the prior art.

As apparent from the foregoing, there is an advantage in the propeller fan according to the present invention thus described in that no abnormal air flows such as backward flow and the like are created to thereby increase discharge of air flow but to decrease noise.

What is claimed is:

1. A propeller fan, the fan including a plurality of vanes, each vane fixed at a hub secured at a rotary axle, having a first vane length toward external radial direction thereof and circumferentially spaced out at a gap between the other vanes in said plurality of vanes, wherein each vane has a cross-sectional shape including a substantially flat surface at an external side of a leading edge thereof, and an external side of a trailing edge thereof is bent with a first vane radius of curvature ($R_C$), wherein the radius of curvature ($R_C$) satisfies a formula of $$R_C = \frac{0.55 \text{ to } 0.6}{R_L} = \frac{0.55 \text{ to } 0.6}{\frac{1}{2}\sqrt{\frac{2\nu Re}{\varpi}}} = \frac{0.55 \text{ to } 0.6}{\frac{1}{2}\sqrt{\frac{2\nu}{\varpi}\frac{UR_L}{\nu}}} = \frac{1.1 \text{ to } 1.2}{\sqrt{\frac{2UR_L}{\varpi}}},$$

where

ω is angular velocity of the fan

U is maximum rotating speed of the vane $R_L$ is the radial distance of the vane, and $$R_L = \frac{1}{2}\sqrt{\frac{2\nu Re}{\omega}},$$

where

ν is coefficient of kinematic viscosity,

Re is critical Reynolds number and

ω is angular velocity of the fan.

2. The fan as defined in claim 1, wherein an angle (θ) at the bent region of the trailing edge is 8° to 18°.

* * * * *